US011393416B2

(12) United States Patent
Yan et al.

(10) Patent No.: US 11,393,416 B2
(45) Date of Patent: Jul. 19, 2022

(54) METHOD AND DEVICE FOR BACKLIGHT CONTROL, ELECTRONIC DEVICE, AND COMPUTER READABLE STORAGE MEDIUM

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Mingyang Yan, Beijing (CN); Chenxi Zhao, Beijing (CN); Jinghua Miao, Beijing (CN); Yukun Sun, Beijing (CN); Wenyu Li, Beijing (CN); Zhifu Li, Beijing (CN); Hao Zhang, Beijing (CN); Lili Chen, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 199 days.

(21) Appl. No.: 16/821,985

(22) Filed: Mar. 17, 2020

(65) Prior Publication Data

US 2021/0056917 A1 Feb. 25, 2021

(30) Foreign Application Priority Data

Aug. 20, 2019 (CN) ..... 201910770358.5

(51) Int. Cl.
*G09G 3/34* (2006.01)

(52) U.S. Cl.
CPC ..... *G09G 3/3426* (2013.01); *G09G 2320/062* (2013.01); *G09G 2320/0646* (2013.01); *G09G 2320/0686* (2013.01); *G09G 2360/16* (2013.01)

(58) Field of Classification Search
None
See application file for complete search history.

(56) References Cited

U.S. PATENT DOCUMENTS

2002/0003522 A1* 1/2002 Baba ..... G09G 3/3651 345/89
2004/0095402 A1* 5/2004 Nakano ..... G09G 3/3406 346/102

(Continued)

FOREIGN PATENT DOCUMENTS

CN 1968380 A 5/2007
CN 101281731 A 10/2008

(Continued)

OTHER PUBLICATIONS

First Chinese Office Action dated Jun. 3, 2020, for corresponding Chinese Application No. 201910770358.5.

*Primary Examiner* — Parul H Gupta
(74) *Attorney, Agent, or Firm* — Kinney & Lange, P.A.

(57) ABSTRACT

The present disclosure provides a method for backlight control, a display device, an electronic device and a computer readable storage medium. The display device may include a backlight module and a display unit. The backlight module includes backlight partitions. The method comprises: determining, with respect to a current frame image, a first backlight brightness value for each backlight partition; determining a scene type of the current frame image according to the first backlight brightness value and a ratio of black regions in the current frame image; obtaining an actual backlight brightness value for each of the plurality of the (Continued)

backlight partitions with respect to the current frame image, by processing the first backlight brightness value according to the scene type determined; and driving the backlight module with the actual backlight brightness value, so as to adjust the backlight brightness for each backlight partition in the backlight module.

15 Claims, 6 Drawing Sheets

(56) References Cited

U.S. PATENT DOCUMENTS

| | | | | |
|---|---|---|---|---|
| 2004/0246242 | A1* | 12/2004 | Sasaki | G09G 3/342 345/204 |
| 2005/0231457 | A1* | 10/2005 | Yamamoto | G09G 3/3413 345/102 |
| 2008/0001881 | A1 | 1/2008 | Baba et al. | |
| 2008/0198117 | A1* | 8/2008 | Kumakura | G09G 3/3648 345/89 |
| 2008/0284719 | A1* | 11/2008 | Yoshida | G02F 1/13392 345/102 |
| 2010/0259653 | A1* | 10/2010 | Kimura | H04N 5/142 348/252 |
| 2011/0025592 | A1 | 2/2011 | Botzas et al. | |
| 2016/0191159 | A1* | 6/2016 | Aoyama | H04B 10/116 398/172 |

FOREIGN PATENT DOCUMENTS

| | | | |
|---|---|---|---|
| CN | 104575406 | A | 4/2015 |
| CN | 107507577 | A | 12/2017 |
| CN | 108346407 | A | 7/2018 |

* cited by examiner

METHOD AND DEVICE FOR BACKLIGHT CONTROL, ELECTRONIC DEVICE, AND COMPUTER READABLE STORAGE MEDIUM

CROSS-REFERENCE TO RELATED APPLICATION(S)

This application claims the priority of Chinese Patent Application No. 201910770358.5, filed on Aug. 20, 2019, the entire contents of which are hereby incorporated by reference.

TECHNICAL FIELD

The present disclosure relates to the field of display technology, and more particularly, to a method and a device for backlight control, an electronic device and a computer readable storage medium.

BACKGROUND

Local backlight control (i.e. local dimming) technology is a technology commonly used in liquid crystal display devices to improve the screen contrast.

SUMMARY

According to an aspect of embodiments of the present disclosure, there is provided a method for controlling backlight of a display device, the display device comprising a backlight module and a display unit, the backlight module comprising a plurality of backlight partitions, the method comprising:

determining, with respect to a current frame image displayed by the display unit, a first backlight brightness value for each of the plurality of backlight partitions;

determining a scene type of the current frame image according to the first backlight brightness value and a ratio of black regions in the current frame image;

obtaining an actual backlight brightness value for each of the plurality of the backlight partitions with respect to the current frame image, by processing the first backlight brightness value according to the scene type determined; and driving the backlight module by using the actual backlight brightness value, so as to adjust the backlight brightness for each backlight partition in the backlight module.

For example, the current frame image comprises a plurality of display regions, and the plurality of display regions correspond to the plurality of backlight partitions respectively; and wherein the determining of the first backlight brightness value for each backlight partitions with respect to the current frame image comprises:

determining an average pixel value of all pixels in the current frame image;

determining a first pixel value for each backlight partition respectively, so that the first pixel value for each backlight partition is greater than a minimum pixel value of all pixels in a corresponding display region to the backlight partition and smaller than a maximum pixel value of all pixels in the corresponding display region; and determining the first backlight brightness value for each backlight partition according to the average pixel value and the first pixel value for each backlight partition.

For another example, the determining of the first backlight brightness value for each backlight partition according to the average pixel value and the first pixel value for each backlight partition comprises:

determining a difference between the average pixel value and the first pixel value;

determining a calculated brightness value according to the difference and a square of the difference; and adding a product value of the average pixel value and a first weighting coefficient to a product value of the calculated brightness value and a second weighting coefficient, so as to obtain the first backlight brightness value for the backlight partition.

For another example, the determining of the scene type of the current frame image according to the first backlight brightness value and the ratio of black regions in the current frame image comprises:

determining a maximum first backlight brightness value among the first backlight brightness values for each of the plurality of backlight partitions, and determining a number of backlight partitions having the first backlight brightness value of zero;

determining the current frame image as being in a first scene mode, if the maximum first backlight brightness value is less than or equal to a first reference brightness value; and determining the scene type of the current frame image according to the number of backlight partitions having the first backlight brightness value of zero, if the maximum first backlight brightness value is greater than the first reference brightness value.

For another example, the determining of the scene type of the current frame image according to the numbers of backlight partitions having the first backlight brightness value of zero comprises:

determining a ratio of the number of the backlight partitions having the first backlight brightness value of zero to the number of the plurality of backlight partitions, based on the number of backlight partitions having the first backlight brightness value of zero;

determining the current frame image as being in a second scene mode, if the ratio is smaller than the first reference ratio; and determining the scene type of the current frame image according to the number of the backlight partitions having the first backlight brightness value of zero among marginal backlight partitions included in the plurality of backlight partitions, if the ratio is greater than or equal to the first reference ratio.

For another example, the determining of the scene type of the current frame image according to the number of the backlight partitions having the first backlight brightness value of zero among marginal backlight partitions included in the plurality of backlight partitions comprises:

determining the number of backlight partitions having the first backlight brightness value of zero among the marginal backlight partitions;

determining the current frame image as being in the first scene mode, if the number of backlight partitions having the first backlight brightness value of zero among the marginal backlight partitions is greater than or equal to a first reference number; and determining the current frame image as being in the second scene mode, if the number of backlight partitions having the first backlight brightness value of zero among the marginal backlight partitions is smaller than the first reference number.

For another example, the obtaining of an actual backlight brightness value for each of the plurality of the backlight partitions with respect to the current frame image by processing the first backlight brightness value according to the scene type determined comprises:

determining a first brightness difference between the first backlight brightness value for each backlight partition and the actual backlight brightness value for each backlight partition with respect to a previous frame image, in response to determining that the current frame image is in a first scene mode; and determining the actual backlight brightness value for each backlight partition with respect to the current frame image according to the first brightness difference.

For another example, the determining of the actual backlight brightness value for each backlight partition with respect to the current frame image according to the first brightness difference comprises:

using the first backlight brightness value for the backlight partition with respect to the current frame image as the actual backlight brightness value for backlight partition with respect to the current frame image, if an absolute value of the first brightness difference is less than a preset brightness change step value; and using the difference obtained by subtracting the preset brightness change step value from the actual backlight brightness value for the backlight partition with respect to the previous frame image as the actual backlight brightness value for backlight partition with respect to the current frame image, If the absolute value of the first brightness difference is greater than the preset brightness change step value, and the first backlight brightness value for the backlight partition with respect to the current frame image is smaller than the actual backlight brightness value for the backlight partition with respect to the previous image frame.

For another example, the obtaining of the actual backlight brightness value for each of the plurality of the backlight partitions with respect to the current frame image by processing the first backlight brightness value according to the scene type determined comprises:

determining a second backlight brightness value for each backlight partition with respect to the current frame image according to a maximum first backlight brightness value among the first backlight brightness values for the plurality of backlight partitions with respect to the current frame image, in response to determining that the current frame image is in a second scene mode, wherein the second backlight brightness value is greater than the first backlight brightness value for each backlight partition; and determining a second brightness difference between the second backlight brightness value for each backlight partition with respect to the current frame image and the actual backlight brightness value for each backlight partition with respect to the previous frame image; and determining the actual backlight brightness value for each backlight partition with respect to the current frame image according to the second brightness difference.

For another example, the determining of the second backlight brightness value for each backlight partition with respect to the current frame image according to the maximum first backlight brightness value among the first backlight brightness values for the plurality of backlight partitions with respect to the current frame image comprises:

determine the maximum first backlight brightness value among the first backlight brightness values for the plurality of backlight partitions with respect to the current frame image; and determining the second backlight brightness value for each backlight partition with respect to the current frame image, according to the maximum first backlight brightness value, the second reference brightness value, and the first backlight brightness values for the plurality of backlight partitions with respect to the current frame image.

For another example, the determining of the second backlight brightness value for each backlight partition with respect to the current frame image according to the maximum first backlight brightness value, the second reference brightness value, and the first backlight brightness values for the plurality of backlight partitions with respect to the current frame image comprises:

using the second reference brightness value as the second backlight brightness value for the backlight partition with respect to the current frame image, in response to the maximum first backlight brightness value being less than or equal to the second reference brightness value; and using a value as the second backlight brightness value for the backlight partition with respect to the current frame image, in response to the maximum first backlight brightness value being greater than the second reference brightness value, wherein the value is obtained by dividing the second backlight brightness value for the backlight partition with respect to the current frame image by the maximum first backlight brightness value so as to obtain a quotient, multiplying the quotient with a difference obtained by subtracting the second reference brightness value from the maximum first backlight brightness value to obtain a compressed brightness value; and adding the second reference brightness value to the compressed brightness value.

For another example, the determining of the actual backlight brightness value for each backlight partition with respect to the current frame image according to the second brightness difference comprises:

using the second backlight brightness value for the backlight partition with respect to the current frame image as the actual backlight brightness value for the backlight partition with respect to the current frame image, if the absolute value of the second brightness difference is smaller than the preset brightness change step value;

using a sum obtained by adding the actual backlight brightness value for the backlight partition with respect to the previous frame image to the preset brightness change step value, as the actual backlight brightness value for the backlight partition with respect to the current frame image, if the absolute value of the second brightness difference is greater than the preset brightness change step value and the second backlight brightness value for the backlight partition with respect to the current frame image is greater than the actual backlight brightness value for the backlight partition with respect to the previous frame image; and using a difference obtained by subtracting the preset brightness change step value from the actual backlight brightness value for the backlight partition with respect to the previous frame image, as the actual backlight brightness value for the backlight partition with respect to the current frame image, if the absolute value of the second brightness difference is greater than the preset brightness change step value and the second backlight brightness value for the backlight partition with respect to the current frame image is smaller than the actual backlight brightness value for the backlight partition with respect to the previous frame image.

According to another aspect of the embodiments of the present disclosure, there is provided a device for controlling backlight, comprising:

a first calculating module configured to determine, with respect to a current frame image, a first backlight brightness value for each of the plurality of backlight partitions;

a scene type determining module configured to determine a scene type of the current frame image according to the first backlight brightness values and a ratio of black regions in the current frame image;

a second calculating module configured to obtain an actual backlight brightness value for each backlight partition with respect to the current frame image by processing the first backlight brightness value according to the scene type determined; and a driving module configured to driving a backlight module by using the actual backlight brightness value, so as to adjust the backlight brightness for each backlight partition in the backlight module.

According to yet another aspect of the embodiments of the present disclosure, there is provided an electronic device comprising:

a processor; and a memory configured to store machine-readable instructions which when executed by the processor, cause the processor to execute the method for controlling the backlight of claim 1.

According to still another aspect of the embodiments of the present disclosure, there is provided a display device comprising:

a backlight module comprising a plurality of backlight partitions;

a display unit configured to display an image frame; and the device for controlling backlight according to the embodiments of the present disclosure.

According to another aspect of the embodiments of the present disclosure, there is provided a display device comprising:

a backlight module comprising a plurality of backlight partitions;

a display unit configured to display an image frame; and the electronic device according to the embodiments of the present disclosure.

According to another aspect of the embodiments of the present disclosure, there is provided a non-transitory computer-readable storage medium having stored thereon computer programs that are configured to, when executed by a processor, implement the method according to the embodiments of the present disclosure.

BRIEF DESCRIPTION OF THE DRAWINGS

The above and/or additional aspects and advantages of the present disclosure will become apparent and easily understood from the following description of the embodiments with reference to the accompanying drawings, in which.

DETAILED DESCRIPTION

Figure 1:
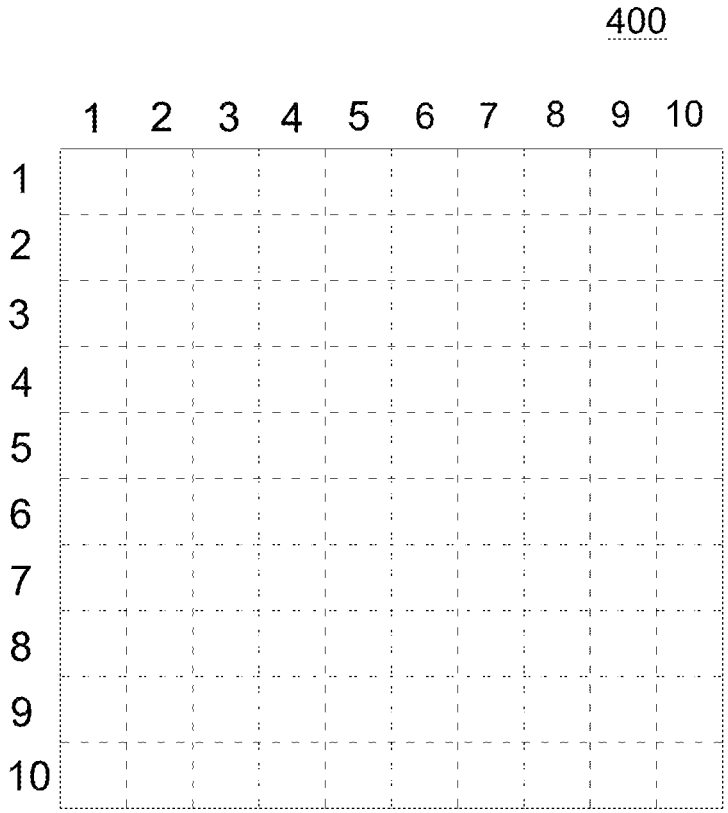
FIG. 1 shows a schematic diagram for backlight partition division of a display device according to an embodiment of the present disclosure.

The present disclosure is described in detail below. Examples of embodiments of the present disclosure are shown in the drawings, wherein the same or similar reference numerals indicate the same or similar components or components having the same or similar functions. Further, detailed description of well-known technologies will be omitted to avoid unnecessarily obscuring the present disclosure. The embodiments described below with reference to the drawings are exemplary, and are only used to explain the present disclosure, and cannot be construed as limiting the present disclosure.

Those skilled in the art will understand that, unless otherwise defined, all terms (including technical and scientific terms) used herein have the same meaning as generally understood by those skilled in the art to which the disclosure belongs. It should also be understood that terms such as those defined in a general dictionary should be understood to have meanings consistent with the meaning in the context of the prior art, and should not be explained with idealized or overly formal meanings, unless otherwise defined.

Those skilled in the art will understand that, unless otherwise defined, the singular forms "a", "an", said" and "the" may include plural forms. It should be further understood that the term of "comprise" used in the specification of the present disclosure refers to the presence of the described features, integers, steps, operations, elements and/or components, but does not exclude the presence or addition of one or more other features, integers, steps, operations, elements, components, and/or combinations thereof. As used herein, the term "and/or" comprises all or any of one or more associated listed items and combinations thereof.

Local backlight control (also referred to "local dimming") is a technique commonly used in display devices, such as liquid crystal display devices, to improve screen contrast. When the display device is used in an environment with strong ambient light, the backlight flicker phenomenon of the display device may not be prone to be perceived by the user, due to the influence of the strong ambient light. Therefore, the viewing experience of the user may not be significantly affected. However, when the display screen of the display device is located in a darker environment, the user would be more sensitive to slight changes in the brightness of the display screen. Thus, it may be prone to perceive the backlight flicker phenomenon, thereby affecting the viewing experience of the user.

As shown in FIG. 1, the display device 400 may include a backlight module and a display unit. The backlight module is used to provide backlight to the display unit. The backlight module may include plurality of backlight partitions, and the backlight brightness value for each backlight partition can be adjusted independently to improve the screen contrast.

The number of backlight partitions of the display device 400 can be determined according to actual needs. The backlight module of the display device 400 shown in FIG. 1 has 100 backlight partitions. It is provided in the embodiments of the present disclosure that the backlight partition (a, b) refers to a backlight partition with a row coordinate of a and a column coordinate of b.

Figure 2:
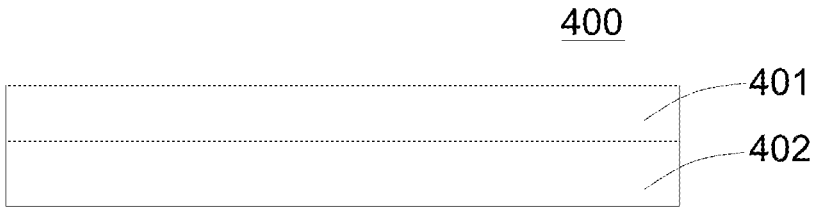
FIG. 2 shows a side view of the display device shown in FIG. 1 according to an embodiment of the present disclosure.

As shown in FIG. 2, the display unit 401 and the backlight module 402 of the display device 400 are stacked together. One backlight partition corresponds to one display region of the display unit 401 and at least one light emitter in the backlight module 402. The light emitter may be an LED (Light Emitting Diode). The backlight brightness of the backlight partition is actually the luminance of the light emitter corresponding to the backlight partition. By adjusting the luminance of the light emitter corresponding to the backlight partition, the brightness of the image displayed in the display region corresponding to the backlight partition can be adjusted.

One local dimming technology is to determine, with respect to each backlight partition, the backlight brightness value corresponding to the display signal of the current frame image, and adjust the luminance of the corresponding light emitter directly according to the backlight brightness value for each backlight partition via the backlight module 402, thereby changing the backlight brightness of the backlight partition.

The display device 400 which the local dimming technology is applied to may have a backlight flicker phenomenon. When the display device 400 is used in an environment with strong ambient light (such as a TV set disposed in a bright space or a mobile phone used in a bright environment), the backlight flicker phenomenon of the display device 400 may not be prone to be perceived by the user, due to the influence of the ambient light. Therefore, the viewing experience of the user may not be significantly affected.

However, when the display screen of the display device 400 is used in a darker environment, the user would be more sensitive to slight changes in the brightness of the display screen. Thus, it may be prone to perceive the backlight flicker phenomenon, thereby affecting the viewing experience of the user. Taking a VR (Virtual Reality) device as an example, the user is required to wear the VR device on the head when using it. The VR device conceals the display screen and the user's eyes in a darker environment. When the display screen shows an image, the user is sensitive to slight changes in the brightness of the display screen, and the user is prone to perceive the backlight flicker phenomenon.

The inventor of the present disclosure has found that in the above-mentioned local dimming technology, the method for determining the backlight brightness of the backlight partitions is too single, since the same method is used to determine the backlight brightness of the backlight partitions with respect to images of different scene types. However, the images of different scene types may have different causes for backlight flicker phenomenon. Due to the lack of targeted method for determining the backlight brightness with respect to images of different scene types, the backlight flicker phenomenon cannot be effectively avoided.

Figure 3:
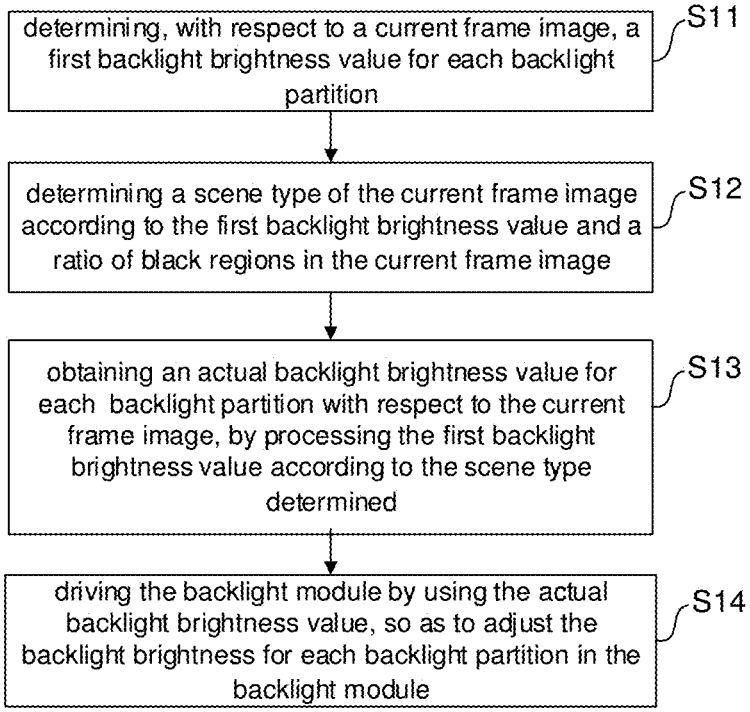
FIG. 3 shows a schematic flowchart of a method for backlight control according to an embodiment of the present disclosure.

Due to above reasons, an embodiment of the present disclosure provides a method for backlight control. As shown in FIG. 3, the method for backlight control according to the embodiment of the present disclosure may include the following steps.

In S11, with respect to a current frame image displayed by the display unit, a first backlight brightness value is determined for each of the plurality of backlight partitions.

When the first backlight brightness values are determined, original detail characteristics of the current frame image should be retained as much as possible, under the condition of satisfying the brightness of the current frame image, so as to enhance the contrast of the displayed current frame image.

The determining of the first backlight brightness value for each backlight partition may comprise:

determining an average pixel value of all pixels in the current frame image; determining a first pixel value for each backlight partition respectively, so that the first pixel value for each backlight partition is greater than a minimum pixel value of all pixels in a corresponding display region to the backlight partition and smaller than a maximum pixel value of all pixels in the corresponding display region; and determining, with respect to the current frame image, the first backlight brightness value for each backlight partition according to the average pixel value and the first pixel value for each backlight partition.

Next, in S12, a scene type of the current frame image is determined, according to the first backlight brightness values for respective backlight partitions with respect to the current frame image and a ratio of black regions in the current frame image.

Figure 4:
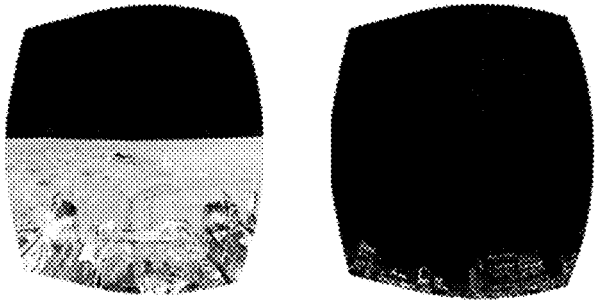
FIG. 4 shows an example for an image of a first scene mode according to an embodiment of the present disclosure.
Figure 5:
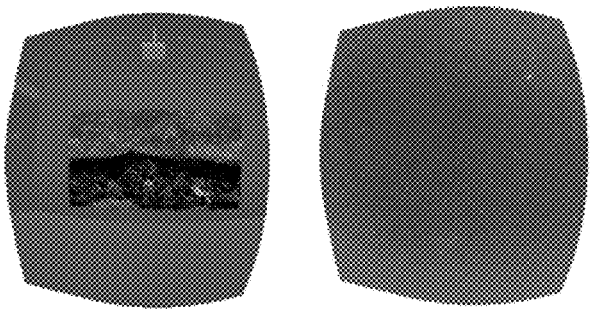
FIG. 5 shows an example for an image of a second scene mode according to an embodiment of the present disclosure.

In the embodiment of the present disclosure, based on the causes for the backlight flicker, at least two scene types are determined in advance according to corresponding parameters of the image. For example, it is determined that the scene types of the current frame image comprises at least a first scene mode and a second scene mode, by considering the first backlight brightness values and the ratio of the black region as references. For example, the first scene mode may be a night scene mode. As an example, as shown in FIG. 4, the illustrated two images are both in the first scene mode such as the night scene mode. As shown in FIG. 5, the illustrated two images are the second scene mode such as the non-night scene mode.

The determining of the scene type of the current frame image according to the first backlight brightness values for the current frame image and the ratio of black regions in the current frame image may comprise:

determining a maximum first backlight brightness value among the first backlight brightness values for each of the plurality of backlight partitions, and determining backlight partitions with the first backlight brightness value for the current frame image being zero; determining the current frame image as being in the first scene mode, if the maximum first backlight brightness value is less than or equal to a first reference brightness value; and determining the scene type of the current frame image according to the numbers of backlight partitions with the first backlight brightness value being zero, if the maximum first backlight brightness value is greater than the first reference brightness value.

In S13, the first backlight brightness value is processed according to the scene type determined, so as to obtain the actual backlight brightness value for each backlight partition with respect to the current frame image.

In the embodiment of the present disclosure, the first backlight brightness value may be processed in at least one manner according to a scene type.

For example, in step S13, the processing of the first backlight brightness value according to the scene type determined, so as to obtain the actual backlight brightness value for each backlight partition with respect to the current frame image may comprise: determining a first brightness difference between the first backlight brightness value for each backlight partition with respect to the current frame image and the actual backlight brightness value for each backlight partition with respect to a previous frame image, if the current frame image is in the first scene mode; and determining the actual backlight brightness value for each backlight partition with respect to the current frame image according to the first brightness difference.

For example, in step S13, the processing of the first backlight brightness value according to the scene type determined, so as to obtain the actual backlight brightness value for each backlight partition with respect to the current frame image may further comprise:

determining a second backlight brightness value for each backlight partition with respect to the current frame image according to the maximum first backlight brightness value among the first backlight brightness values for the plurality of backlight partitions with respect to the current frame image, if the current frame image is in the second scene mode, wherein the second backlight brightness value is greater than the first backlight brightness value for each backlight partition; and determining a second brightness difference between the second backlight brightness value for each backlight partition with respect to the current frame image and the actual backlight brightness value for each backlight partition with respect to the previous frame image; and determining the actual backlight brightness value for each backlight partition with respect to the current frame image according to the second brightness difference.

Then, in S14, the backlight module 402 is driven with the resulting actual backlight brightness values for respective backlight partitions, so as to adjust the backlight brightness for each backlight partition in the backlight module 402.

The backlight module 402 can adjust the luminance brightness of the light emitter corresponding to the backlight partition according to the received actual backlight brightness value for each backlight partition, thereby changing the backlight brightness for the backlight partition.

According to the backlight control method of the embodiment of the present disclosure, scene types are classified in advance depending on the causes for the backlight flicker. When performing the backlight control, the scene type of the current frame image is identified firstly, and then the backlight brightness value for each backlight partition is adjusted by using a targeted optimization method according to the scene type. Because the optimization method for respective backlight brightness is more targeted, it can effectively solve the problem of backlight flicker caused by different causes, and can effectively reduce the probability of occurring the backlight flicker in the display screen of the display device 400 under a darker environment, thereby enhancing the user's viewing experience.

Figure 6:
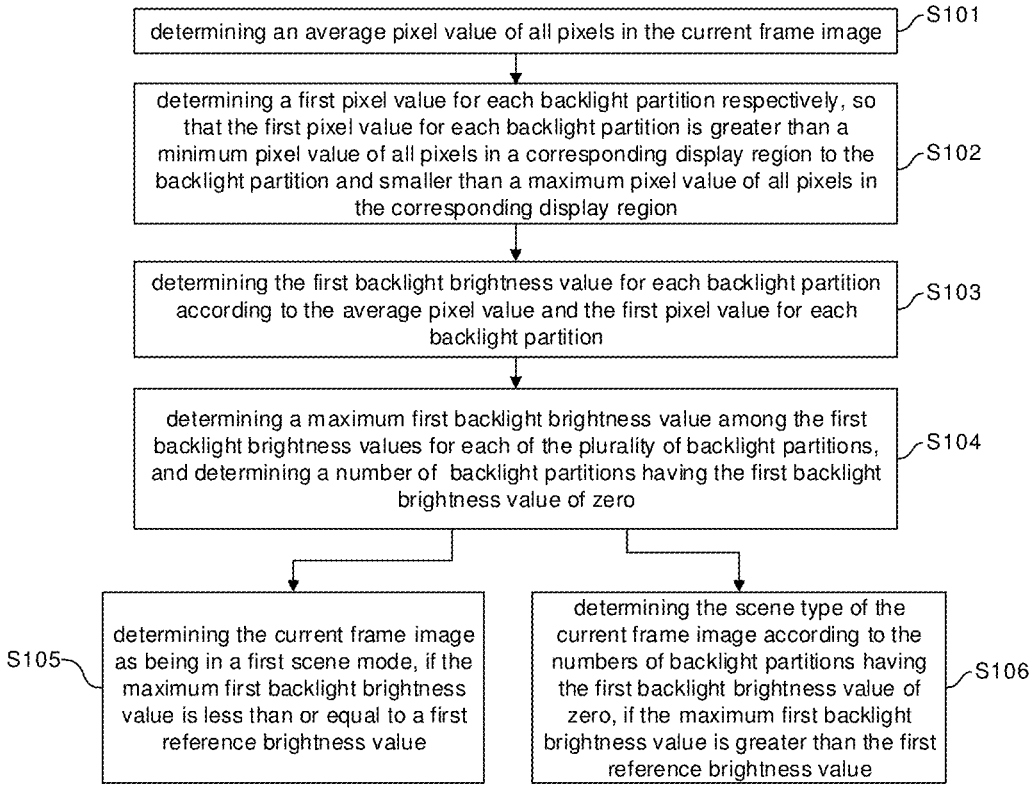
FIGS. 6 to 8 show schematic flowcharts of extension methods for backlight control according to embodiments of the present disclosure.
Figure 7:
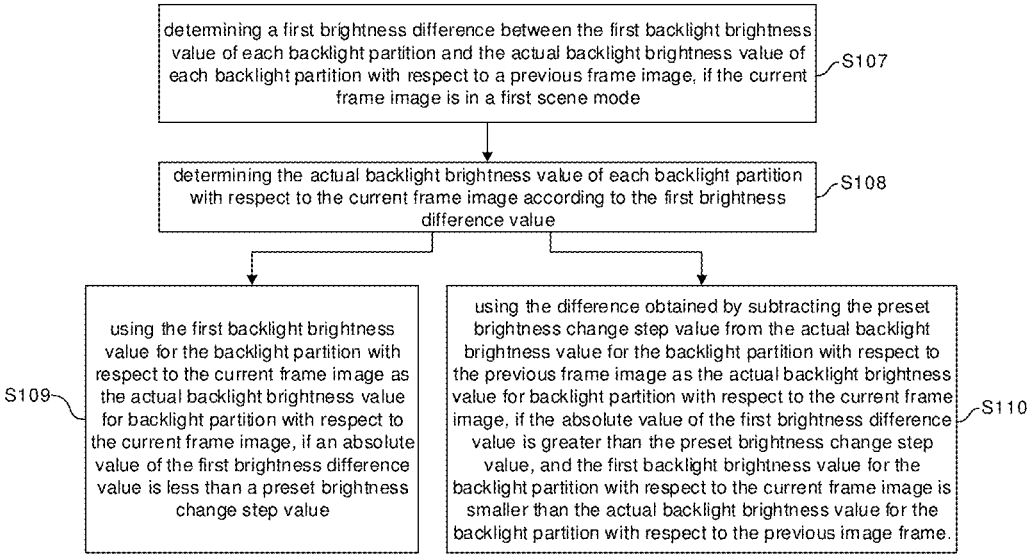
Figure 8:
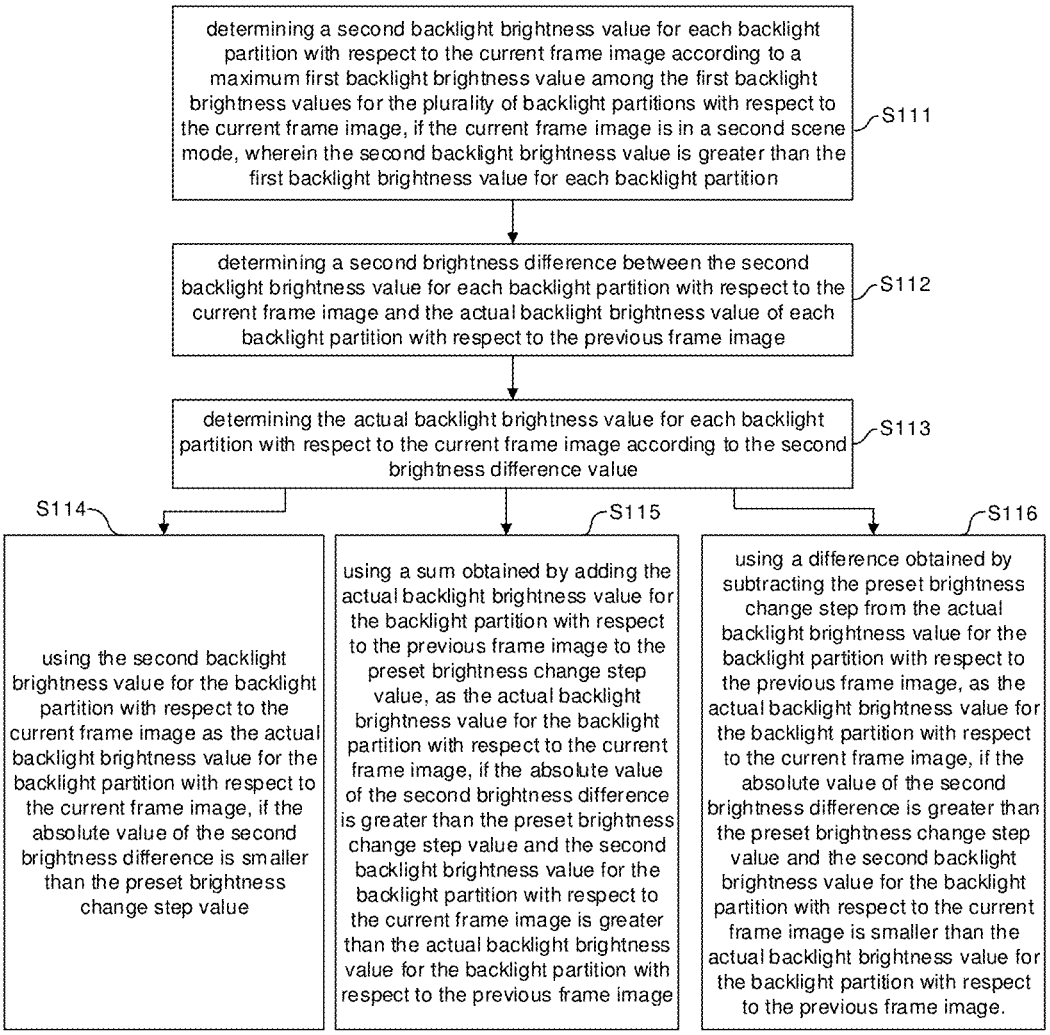

The embodiments of the present disclosure provide several example implementations of the backlight control method. Next, a detailed description will be made with reference to FIGS. 6 to 8. As shown in FIGS. 6 to 8, an example of the method according to an embodiment of the present disclosure may include the following steps.

In S101, an average pixel value of all pixels in the current frame image is determined.

It should be noted that the pixel values may be different for different frame images. The average pixel value in step S101 refers to the mean of the pixel values of all pixels in the current frame image.

In the embodiment of the present disclosure, when the plurality of display regions of the display unit 401 are all used to display the current frame image, all pixels mentioned in step S101 refer to all pixels of the display unit 401. When a part of the display regions of the display unit 401 is used to display the current frame image (for example, the current frame image occupies only a half of the display region), all pixels mentioned in step S101 refer to pixels for displaying the current frame image in the display unit 401.

In S102, the first pixel value for each backlight partition is determined respectively. The first pixel value for each backlight partition is greater than a minimum pixel value of all pixels in a corresponding display region to the backlight partition and smaller than a maximum pixel value of all pixels.

One backlight partition corresponds to one display region. With respect to the current frame image, each display region comprises a plurality of pixels. The first pixel value is a value between the minimum pixel value and the maximum pixel value of all pixels in the display region corresponding to the backlight partition, and the first pixel value for respective backlight partition may be different.

Those skilled in the art can understand that the magnitude of the pixel value can be represented by a gray level. Taking the backlight partition (5, 7) in FIG. 1 as an example, among all pixels corresponding to the backlight partition (5, 7), the pixel values are divided into 100 gray levels from low to high by setting the minimum pixel value and the maximum pixel value as the lower limit and the upper limit, respectively. The minimum pixel value corresponds to the first level, and the maximum pixel value corresponds to the $100^{th}$ level. One of the pixel values of the $2^{nd}$ to $99^{th}$ levels is selected as the first pixel value. In the embodiment of the present disclosure, the pixel value of the fifth level is taken as the first pixel value, which may be represented by max5%.

In S103, the first backlight brightness value for each backlight partition with respect to the current frame image is determined according to the average pixel value and the first pixel value for each backlight partition.

For example, the first backlight brightness value for the backlight partition with respect to the current frame image can be obtained by determining a difference between the average pixel value and the first pixel value; determining a calculated brightness value according to the difference and a square of the difference; and adding a product value of the average pixel value and a first weighting coefficient to a product value of the calculated brightness value and a second weighting coefficient.

The above step can be expressed by formula (1):

$$Lnow1=A\times avg+B\times((max5\%-avg)+(max5\%-avg)^2) \quad (1)$$

wherein:

Lnow1 refers to the first backlight brightness value for the backlight partition with respect to the current frame image;

A refers to the first weighting coefficient; and avg refers to the average pixel value;

B refers to the second weighting coefficient; max5% refers to the first pixel value; and $((max5\%-avg)+(max5\%-avg)^2)$ refers to the calculated brightness value.

The first weighting coefficient is related to the light emitting mode of the backlight module of the display device 400, and may range from 1.0 to 1.3.

The second weighting coefficient is related to the number of pixels included in the display region corresponding to the backlight partition. The greater the number of pixels included in the display region, the bigger the second weighting coefficient. For different display devices 400, the second weighting coefficient may be different. For the same display device 400, if the backlight partitions are non-uniformly divided, the second weighting coefficients of the backlight partitions are also different. The second weighting coefficient may range from 0.5 to 1.

When determining the first backlight brightness value by using steps S101 to S103, the original detail characteristics of the current frame image should be retained as much as possible, under the condition of satisfying the brightness of the current frame image, so as to enhance the contrast of the displayed current frame image.

In S104, a maximum first backlight brightness value is determined among the first backlight brightness values for the plurality of backlight partitions with respect to the current frame image, and the backlight partitions with the first backlight brightness value with respect to the current frame image being zero are determined. Then, depending on a relationship between the first backlight brightness value and the first reference brightness value, step S105 or S106 is performed.

In S105, the current frame image is determined as being in a first scene mode, if the maximum first backlight brightness value is less than or equal to a first reference brightness value. In this case, step S107 is then performed.

Those skilled in the art can understand that the first reference brightness value may be determined according to actual design requirements.

The magnitude of the brightness can be represented by a gray level. The gray level is to divide the brightness change between the brightest and the darkest into several levels. In the embodiment of the present disclosure, the brightness value is divided into 255 gray levels, and the brightness value represented by a $33^{rd}$ gray level may be selected as the first reference brightness value. If the gray level corresponding to the maximum first backlight brightness value is less than or equal to 33, which indicates that the maximum first backlight brightness value does not exceed the first reference brightness value, it is determined that the current frame image is in the first scene mode.

In S106, if the maximum first backlight brightness value is greater than the first reference brightness value, the scene type of the current frame image is determined according to the number of backlight partitions having the first backlight brightness value of zero. Then, step S107 or S111 is performed.

In the embodiment of the present disclosure, when the gray levels corresponding to the maximum first backlight brightness value is greater than 33, it indicates that the maximum first backlight brightness value is greater than the first reference brightness value.

In S107, if it is determined that the current frame image is in a first scene mode, a first brightness difference between the first backlight brightness value for each backlight partition with respect to a current frame image and the actual backlight brightness value for each backlight partition with respect to a previous frame image is determined.

The previous frame image refers to an image displayed by the display device 400 before the current frame image. For example, if the current frame image is the $N^{th}$ frame image, the previous frame image refers to the $N-1^{th}$ frame image.

The actual backlight brightness value for each backlight partition with respect to the previous frame image may be stored in the display device 400 and may be directly obtained when performing step 107.

Before determining the first brightness difference, the method may further comprises filtering a signal including the first backlight brightness value for each backlight partition with respect to the current frame image. The filtering may be implemented by using a fixed step.

In S108, the actual backlight brightness value for each backlight partition with respect to the current frame image is determined according to the first brightness difference.

In the embodiment of the present disclosure, the brightness change step value is the maximum brightness change allowed between two adjacent frame images of the embodiment of the present disclosure. The brightness change step value can be determined according to the actual design requirements.

In the embodiment of the present disclosure, the first backlight brightness value for the backlight partition with respect to the current frame image is Lnow1, the actual backlight brightness value for the backlight partition with respect to the previous frame image is Llast, and the actual backlight brightness value for the backlight partition with respect to the current frame image is Lout, the brightness change step value is Lstep, and the first brightness difference is (Lnow1−Llast) or (Llast−Lnow1).

In S109, if an absolute value of the first brightness difference is less than a preset brightness change step value, the first backlight brightness value for the backlight partition with respect to the current frame image is used as the actual backlight brightness value for backlight partition with respect to the current frame image.

That is, if $-Lstep<(Lnow1-Llast)<Lstep$, $Lout=Lnow1$.

In S110, if the absolute value of the first brightness difference is greater than the preset brightness change step value, and the first backlight brightness value for the backlight partition with respect to the current frame image is smaller than the actual backlight brightness value for the backlight partition with respect to the previous image frame, the difference obtained by subtracting the preset brightness change step value from the actual backlight brightness value for the backlight partition with respect to the previous frame image is used as the actual backlight brightness value for backlight partition with respect to the current frame image.

That is, if $Llast>Lnow1$, and $(Llast-Lnow1)>Lstep$, then $Lout=Llast-Lstep$.

In steps S107 to S110 of the embodiment of the present disclosure, the difference between the first backlight brightness value for the backlight partition with respect to the current frame image and the actual backlight brightness value for the backlight partition with respect to the previous frame image is limited to a smaller range, avoiding a sudden brightness change of two adjacent frames images. This ensures that the brightness changes gradually when the images are displayed frame by frame without producing a sense of delay, which improves the displaying effect.

In S111, if the current frame image is in the second scene mode, a second backlight brightness value for each backlight partition with respect to the current frame image is determined according to a maximum first backlight brightness value among the first backlight brightness values for the plurality of backlight partitions with respect to the current frame image, such that the second backlight brightness value is greater than the first backlight brightness value for each backlight partition.

In S112, a second brightness difference between the second backlight brightness value for each backlight partition with respect to the current frame image and the actual backlight brightness value for each backlight partition with respect to the previous frame image is determined.

In S113, the actual backlight brightness value for each backlight partition with respect to the current frame image is determined according to the second brightness difference, and then steps S114, S115, or S116 are performed.

In the embodiment of the present disclosure, the second backlight brightness value for the backlight partition with respect to the current frame image is Lnow2, the actual backlight brightness value for the backlight partition with respect to the previous frame image is Llast, the actual backlight brightness value for the backlight partition with respect to the current frame image is Lout, the brightness change step value is Lstep, and the second brightness difference will be (Lnow2−Llast) or (Llast−Lnow2).

In S114, if the absolute value of the second brightness difference is smaller than the brightness change step value, the second backlight brightness value for the backlight partition with respect to the current frame image is used as the actual backlight brightness value for the backlight partition with respect to the current frame image.

For example, if −Lstep<(Lnow2−Llast)<Lstep, Lout=Lnow2.

In S115, if the absolute value of the second brightness difference is greater than the brightness change step value and the second backlight brightness value for the backlight partition with respect to the current frame image is greater than the actual backlight brightness value for the backlight partition with respect to the previous frame image, a sum obtained by adding the actual backlight brightness value for the backlight partition with respect to the previous frame image to the preset brightness change step value is used as the actual backlight brightness value for the backlight partition with respect to the current frame image.

For example, if Llast<Lnow2, and (Lnow2−Llast)>Lstep, Lout=Llast+Lstep.

In S116, if the absolute value of the second brightness difference is greater than the preset brightness change step value, and the second backlight brightness value for the backlight partition with respect to the current frame image is smaller than the actual backlight brightness value for the backlight partition with respect to the previous frame image, a difference obtained by subtracting the preset brightness change step value from the actual backlight brightness value for the backlight partition with respect to the previous frame image is used as the actual backlight brightness value for the backlight partition with respect to the current frame image.

For example, if Llast>Lnow2 and (Llast−Lnow2)>Lstep, Lout=Llast−Lstep.

In steps S112 to S116 of the embodiment of the present disclosure, the difference between the first backlight brightness value for the backlight partition with respect to the current frame image and the actual backlight brightness value for the backlight partition with respect to the previous frame image is limited to a smaller range, avoiding a sudden brightness change of two adjacent frames images. This ensures that the brightness changes gradually when the images are displayed frame by frame without producing a sense of delay, which improves the displaying effect.

Figure 9:
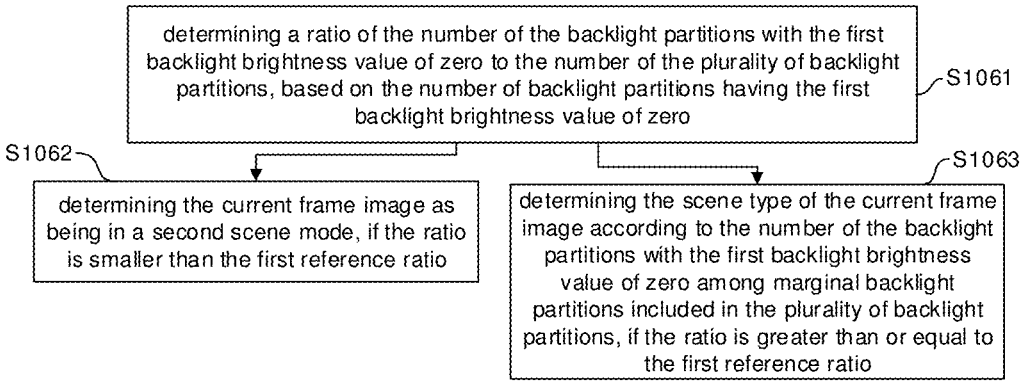
FIG. 9 shows an exemplary schematic flowchart of step S106 according to an embodiment of the present disclosure.

For example, FIG. 9 shows a schematic flowchart of an exemplary method for determining the scene type of the current frame image according to the numbers of backlight partitions having the first backlight brightness value of zero in step S106. As shown in FIG. 9, the exemplary method may include the following steps.

In S1061, a ratio of the number of the backlight partitions having the first backlight brightness value of zero to the number of the plurality of backlight partitions is determined based on the number of backlight partitions having the first backlight brightness value of zero. Then, step S1062 or S1063 is performed.

Taking FIG. 1 as an example, the backlight module comprises 100 backlight partitions, and the 100 backlight partitions are all used to display the current frame image. If there are 10 backlight partitions with a first backlight brightness value with respect to the current frame image being zero, the ratio of the backlight partitions having the first backlight brightness value of zero to all backlight partitions is 10/100, that is, 10%.

In S1062, the current frame image is determined as being in a second scene mode, if the ratio is smaller than the first reference ratio.

Those skilled in the art can understand that the first reference ratio may be determined according to actual design requirements.

In the embodiment of the present disclosure, the first reference ratio may be 25%. If the ratio of the backlight partition having the first backlight brightness value of zero to all backlight partitions is less than 25%, it is determined that the current frame image is in the second scene mode. Of course, the first reference ratio may be selected from other values.

In the embodiment of the present disclosure, step S1062 is followed by step S111.

In S1063, the scene type of the current frame image is determined according to the number of the backlight partitions having the first backlight brightness value of zero among the marginal backlight partitions corresponding to respective marginal display regions of the current frame image, if the ratio is greater than or equal to the first reference ratio. Then, S107 or S111 is performed.

For example, the first reference ratio is 25%. If the ratio of the backlight partitions having the first backlight brightness value of zero to all backlight partitions is greater than or equal to 25%, the scene type of the current frame image is determined according to the number of the backlight partitions having the first backlight brightness value of zero among the marginal backlight partitions corresponding to respective marginal display regions of the current frame image.

For example, in step S1063, the determining of the scene type of the current frame image according to the number of the backlight partitions having the first backlight brightness value of zero among the marginal backlight partitions corresponding to respective marginal display regions of the current frame image may comprise: determining the number of backlight partitions having the first backlight brightness value of zero among the marginal backlight partitions corresponding to respective marginal display regions of the current frame image.

The current frame image is determined as being in the first scene mode, if the number of backlight partitions having the first backlight brightness value of zero among the marginal backlight partitions corresponding to respective marginal display regions of the current frame image is greater than or equal to the first reference number.

The current frame image is determined as being in the second scene mode, if the number of backlight partitions having the first backlight brightness value of zero among the marginal backlight partitions corresponding to respective marginal display regions of the current frame image is smaller than the first reference number.

Figure 11:
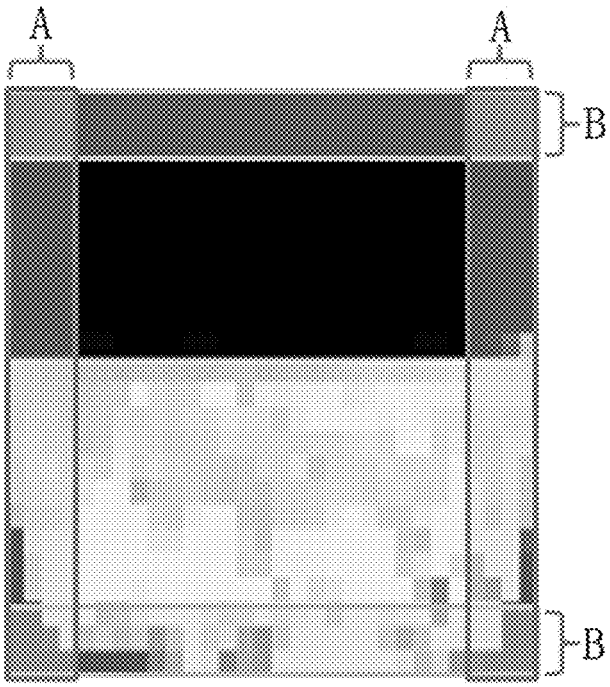
FIG. 11 shows a schematic diagram for marginal region division of an image according to an embodiment of the present disclosure.

In the embodiment of the present disclosure, the marginal display regions of the current frame image may be ranged according to actual design requirements. Taking FIG. 1 as an example, the backlight module comprises 100 backlight partitions, and the 100 backlight partitions are all used to display the current frame image. The backlight partitions in the first and second columns, the backlight partitions in the ninth and tenth columns, the backlight partitions in the first and second rows, and the backlight partitions in the ninth and tenth rows can be used as the backlight partitions corresponding to the first to fourth marginal display regions of the current frame image, wherein each marginal display region comprises 20 backlight partitions. Of course, other selection criteria can also be used to determine the backlight partition corresponding to the marginal display region of the current frame image, which will not be repeated here. As shown in FIG. 11, the left and right regions A in the image are a first marginal display region and a second marginal display region, and the upper and lower regions B in the image are a third marginal display region and a fourth marginal display region, respectively.

In the embodiment of the present disclosure, the first reference number may be determined according to actual design requirements. For example, 80% of the backlight partitions corresponding to the marginal display regions is used as the first reference number. In the embodiment of the present disclosure, the first reference number of each marginal display region may be 16. For any marginal display region of the current frame image, if the number of backlight partitions having the first backlight brightness value of zero is greater than or equal to 16, it is determined that the current frame image is in the first scene mode. If the number of backlight partitions having the first backlight brightness value of zero is less than 16, it is determined that the current frame image is in the second scene mode.

In the embodiment of the present disclosure, if it is determined that the current frame image is in the first scene mode in step S1063, step S1063 is followed by step S107; if it is determined that the current frame image is in the second scene mode in step S1063, step S1063 is followed by step S111.

Figure 10:
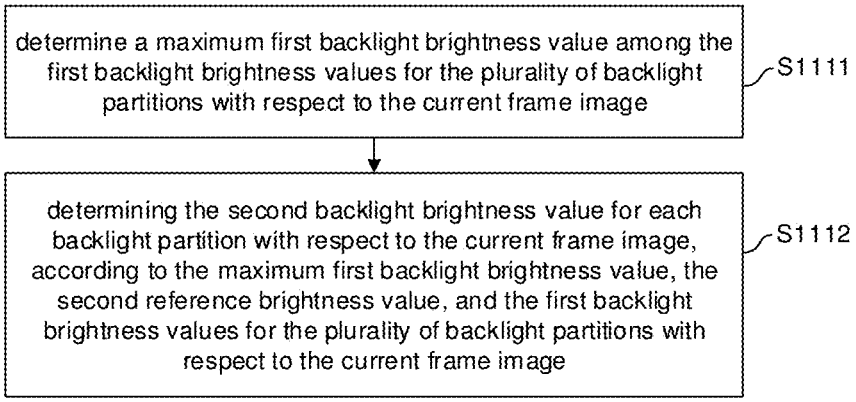
FIG. 10 shows an exemplary schematic flowchart of step S111 according to an embodiment of the present disclosure.

For example, FIG. 10 shows a schematic flowchart of the exemplary method for determining the second backlight brightness value for each backlight partition with respect to the current frame image according to the maximum first backlight brightness value among the first backlight brightness values for all backlight partitions with respect to the current frame image in step S111. As shown in FIG. 10, the method may include the following steps.

In S1111, the maximum first backlight brightness value is determined among the first backlight brightness values for all backlight partitions with respect to the current frame image.

It should be noted that if the maximum first backlight brightness value has been determined in step S104, S1111 may be omitted, and the maximum first backlight brightness value determined in step S104 may be directly used in step S1112.

In S1112, the second backlight brightness value for each backlight partition with respect to the current frame image is determined according to the maximum first backlight brightness value, a second reference brightness value, and the first backlight brightness values for all of the plurality of backlight partitions with respect to the current frame image.

According to an embodiment of the present disclosure, the second reference brightness value is a minimum backlight brightness value allowed in the second scene mode. The specific value of the second reference brightness value may be determined according to actual design requirements.

In the embodiment of the present disclosure, the first backlight brightness value for the backlight partition with respect to the current frame image is Lnow1, the second backlight brightness value for the backlight partition with respect to the current frame image is Lnow2, the second reference brightness value is Lth, and the maximum first backlight brightness value among the first backlight values for all of the plurality of backlight partitions with respect to the current frame image is Lmax.

For example, the determining of the second backlight brightness value for each backlight partition with respect to the current frame image according to the maximum first backlight brightness value, a second reference brightness value, and the first backlight brightness values for all of the plurality of backlight partitions with respect to the current frame image in step S1112 may comprise following steps.

If the maximum first backlight brightness value is less than or equal to the second reference brightness value, the second reference brightness value is used as the second backlight brightness value for the backlight partition with respect to the current frame image.

That is, if Lmax<Lth or Lmax=Lth, Lnow2=Lth.

If the maximum first backlight brightness value is greater than the second reference brightness value, the second backlight brightness value for the backlight partition with respect to the current frame image is calculated by dividing the second backlight brightness value for the backlight partition with respect to the current frame image by the maximum first backlight brightness value so as to obtain a quotient, multiplying the quotient with a difference obtained by subtracting the second reference brightness value from the maximum first backlight brightness value to obtain a compressed brightness value; and adding the second reference brightness value to the compressed brightness value.

That is, if Lmax>Lth, the second backlight brightness value for the backlight partition with respect to the current frame image is Lnow2, which can be given by formula (2):

$$Lnow2=Lth+(Lnow1/Lmax)(Lmax-Lth) \quad \text{formula (2)}$$

The inventors of the present disclosure have found that when the backlight brightness of the display device 400 is low, the backlight flicker is more easily to be perceived. In step S111 of the embodiment of the present disclosure, when the current frame image is in the first scene mode, on the one hand, the brightness for all backlight partitions is improved overall, reducing the user's subjective sensitivity to backlight flicker. On the other hand, the difference between the minimum backlight brightness value and the maximum backlight brightness value among all backlight partitions is reduced. That is, the span of backlight brightness is compressed, thereby reducing the probability of backlight flicker.

Figure 12:
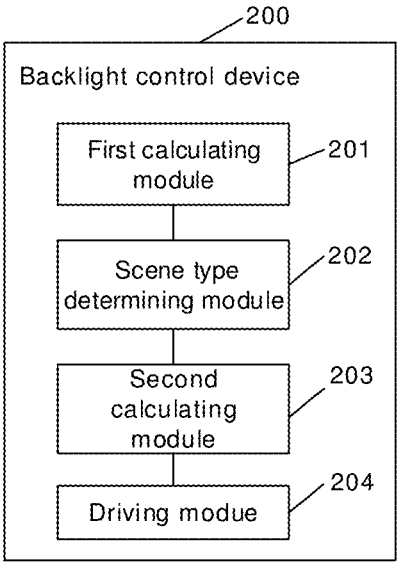
FIG. 12 shows a schematic block diagram of a backlight control device according to an embodiment of the present disclosure.

Based on the same inventive concept, the embodiments of the present disclosure further provides a backlight controlling device 200, for performing the method for controlling the backlight of the embodiment of the present disclosure. As shown in FIG. 12, the backlight control device 200 may comprise a first calculating module 201, a scene type determination module 202, a second calculating module 203, and a driving module 204.

The first calculating module 201 is configured to determine, with respect to the current frame image, the first backlight brightness value for each of the plurality of backlight partitions.

The scene type determining module 202 is configured to determine a scene type of the current frame image according to respective first backlight brightness values and a ratio of black regions in the current frame image.

The second calculating module 203 is configured to obtain an actual backlight brightness value for each backlight partition with respect to the current frame image by processing the first backlight brightness value according to the scene type determined.

The driving module 204 is configured to driving the backlight module 402 by using the actual backlight brightness value, so as to adjust the backlight brightness for each backlight partition in the backlight module 402.

Figure 13:
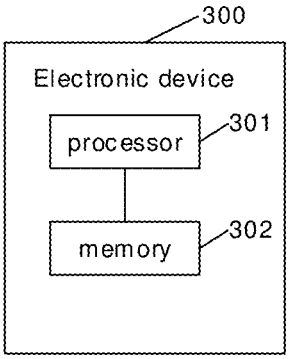
FIG. 13 shows a schematic structural diagram of an electronic device according to an embodiment of the present disclosure.

Based on the same inventive concept, the embodiments of the present disclosure further provides an electronic device 300. As shown in FIG. 13, the electronic device 300 may comprise: a processor 301 and a memory 302. Optionally, the electronic device 300 comprises the display device 400 of the embodiments of the present disclosure.

The memory 302 is configured to store machine-readable instructions. When the instructions are executed by the processor 301, the processor 301 executes the method for controlling backlight of the embodiments of the present disclosure.

The memory 302 in the embodiment of the present disclosure may be a ROM (Read-Only Memory, read-only memory 302) or another types of static storage devices that can store static information and instructions, a RAM (Random Access Memory, random access memory 302) or other types of dynamic storage devices that can store information and instructions, an EEPROM (Electrically Erasable Programmable Read Only Memory, electrically erasable programmable read only memory 302), a CD-ROM (Compact Disc Read-Only Memory, read-only discs) or other optical disk storages, optical disk storages (including compact discs, laser discs, optical discs, digital versatile discs, Blu-ray discs, etc.), disk storage media or other magnetic storage devices, or any other medium that can be used to carry or store desired program code with instructions or data structures and can be accessed by a computer, which is not limited thereto.

The processor 301 in the embodiment of the present disclosure may be a CPU (Central Processing Unit, central processing unit 301), a general-purpose processor 301, a DSP (Digital Signal Processor, data signal processor 301), an ASIC (Application Specific Integrated Circuit), a FPGA (Field-Programmable Gate Array), or other programmable logic devices, transistor logic devices, hardware components, or any combination thereof, which may implement or execute various exemplary logical blocks, modules, and circuits described in connection with the present disclosure. The processor 301 may also be a combination that may implement a computing function, for example, a combination including one or more microprocessors 301, a combination of a DSP and a microprocessor 301, and the like.

Those skilled in the art can understand that a prediction device for the engineering construction plan according to the embodiments of the present disclosure may be specially designed and manufactured for the desired purpose, or may also include a well-known device in a general-purpose computer. These devices have computer programs stored therein that are selectively activated or reconstructed. Such a computer program may be stored in a device (e.g., a computer) readable medium or in any type of medium suitable for storing electronic instructions and being separately coupled to a bus.

The electronic device 300 according to the embodiment of the present disclosure has the same inventive concept and beneficial effects as the embodiments described above, which will not be repeated here.

Based on the same inventive concept, the embodiments of the present disclosure further provides a non-transitory computer-readable storage medium having computer programs stored thereon, which are configured to, when executed by the processor 301, implement the method for backlight control according to the embodiments of the present disclosure.

The computer-readable storage medium comprises, but is not limited to, any type of disks (including floppy disks, hard disks, optical disks, CD-ROMs, and magneto-optical disks), a ROM, a RAM, and an EPROM (Erasable Programmable Read-Only Memory, erasable programmable read-only memory 302), an EEPROM, a flash memory, a magnetic card or an optical card. That is, a readable medium comprises any medium on which the device (e.g., a computer) may store or transfer information in a readable form.

The computer-readable storage medium according to the embodiments of the present disclosure has the same inventive concept and beneficial effects as the embodiments described above, which is not repeated here.

Those skilled in the art can understand that steps, measures, and solutions in various operations, methods and flowcharts that have been discussed in this application can be substituted, modified, combined, or deleted. Further, other steps, measures, and solutions in various operations, methods and flowcharts that have been discussed in this application can be substituted, modified, rearranged, decomposed, combined, or deleted. Further, steps, measures, and solutions in various operations, methods and flowcharts in the prior art that have been discussed in this application can also be substituted, modified, rearranged, decomposed, combined, or deleted.

The terms "first" and "second" are used for descriptive purposes only, and cannot be understood as indicating or implying relative importance or implicitly indicating the number of technical features indicated. Therefore, the features defined by "first" and "second" may explicitly or implicitly include one or more of the features. In the description of the present disclosure, "a plurality of" means two or more, unless otherwise stated.

It should be understood that although the steps in the flowchart of the drawings are sequentially displayed in accordance with the arrows, these steps are not necessarily performed in an order indicated by the arrows. Unless otherwise explicitly stated, the execution order of these steps is not strictly limited. In fact, these steps can be performed in other orders. Moreover, at least a part of the steps in the flowchart drawing may include a plurality of sub-steps or a plurality of stages. Such sub-steps or stages are not necessarily executed at the same time, but may be executed at different times. Further, such sub-steps or stages are not necessarily performed sequentially, but may be performed in turn or alternately with other steps, the sub-steps of other steps, or at least a part of stages.

The above description is only part of the implementation of the present application. It should be noted that those of ordinary skill in the art may make several improvements and modifications without departing from the principles of the present disclosure, which should be regarded as being within the scope of present disclosure.

We claim:

1. A method for controlling backlight of a display device, the display device comprising a backlight module and a display unit, the backlight module comprising a plurality of backlight partitions, the method comprising:

determining, with respect to a current frame image displayed by the display unit, a first backlight brightness value for each of the plurality of backlight partitions;

determining a scene type of the current frame image according to the first backlight brightness value and a ratio of black regions in the current frame image;

obtaining an actual backlight brightness value for each of the plurality of the backlight partitions with respect to the current frame image, by processing the first backlight brightness value according to the scene type determined; and driving the backlight module by using the actual backlight brightness value, so as to adjust the backlight brightness for each backlight partition in the backlight module.

2. The method of claim 1, wherein the current frame image comprises a plurality of display regions, and the plurality of display regions correspond to the plurality of backlight partitions respectively; and wherein the determining of the first backlight brightness value for each backlight partitions with respect to the current frame image comprises:

determining an average pixel value of all pixels in the current frame image;

determining a first pixel value for each backlight partition respectively, so that the first pixel value for each backlight partition is greater than a minimum pixel value of all pixels in a corresponding display region to the backlight partition and smaller than a maximum pixel value of all pixels in the corresponding display region; and determining the first backlight brightness value for each backlight partition according to the average pixel value and the first pixel value for each backlight partition.

3. The method of claim 2, wherein the determining of the first backlight brightness value for each backlight partition according to the average pixel value and the first pixel value for each backlight partition comprises:

determining a difference between the average pixel value and the first pixel value;

determining a calculated brightness value according to the difference and a square of the difference; and adding a product value of the average pixel value and a first weighting coefficient to a product value of the calculated brightness value and a second weighting coefficient, so as to obtain the first backlight brightness value for the backlight partition.

4. The method of claim 1, wherein the determining of the scene type of the current frame image according to the first backlight brightness value and the ratio of black regions in the current frame image comprises:

determining a maximum first backlight brightness value among the first backlight brightness values for all of the plurality of backlight partitions, and determining a number of backlight partitions having the first backlight brightness value of zero;

determining the current frame image as being in a first scene mode, if the maximum first backlight brightness value is less than or equal to a first reference brightness value; and determining the scene type of the current frame image according to the number of backlight partitions having the first backlight brightness value of zero, if the maximum first backlight brightness value is greater than the first reference brightness value.

5. The method of claim 4, wherein the determining of the scene type of the current frame image according to the numbers of backlight partitions having the first backlight brightness value of zero comprises:

determining a ratio of the number of the backlight partitions having the first backlight brightness value of zero to the number of the plurality of backlight partitions, based on the number of backlight partitions having the first backlight brightness value of zero;

determining the current frame image as being in a second scene mode, if the ratio is smaller than the first reference ratio; and determining the scene type of the current frame image according to the number of the backlight partitions having the first backlight brightness value of zero among marginal backlight partitions included in the plurality of backlight partitions, if the ratio is greater than or equal to the first reference ratio.

6. The method of claim 5, wherein the determining of the scene type of the current frame image according to the number of the backlight partitions having the first backlight brightness value of zero among marginal backlight partitions included in the plurality of backlight partitions comprises:

determining the number of backlight partitions having the first backlight brightness value of zero among the marginal backlight partitions;

determining the current frame image as being in the first scene mode, if the number of backlight partitions having the first backlight brightness value of zero among the marginal backlight partitions is greater than or equal to a first reference number; and determining the current frame image as being in the second scene mode, if the number of backlight partitions having the first backlight brightness value of zero among the marginal backlight partitions is smaller than the first reference number.

7. The method of claim 1, wherein the obtaining of an actual backlight brightness value for each of the plurality of the backlight partitions with respect to the current frame image by processing the first backlight brightness value according to the scene type determined comprises:

determining a first brightness difference between the first backlight brightness value for each backlight partition and the actual backlight brightness value for each backlight partition with respect to a previous frame image, in response to determining that the current frame image is in a first scene mode; and determining the actual backlight brightness value for each backlight partition with respect to the current frame image according to the first brightness difference.

8. The method of claim 7, wherein the determining of the actual backlight brightness value for each backlight partition with respect to the current frame image according to the first brightness difference comprises:

using the first backlight brightness value for the backlight partition with respect to the current frame image as the actual backlight brightness value for backlight partition with respect to the current frame image, if an absolute value of the first brightness difference is less than a preset brightness change step value; and using the difference obtained by subtracting the preset brightness change step value from the actual backlight brightness value for the backlight partition with respect to the previous frame image as the actual backlight brightness value for backlight partition with respect to the current frame image, if the absolute value of the first brightness difference is greater than the preset brightness change step value, and the first backlight brightness value for the backlight partition with respect to the current frame image is smaller than the actual backlight brightness value for the backlight partition with respect to the previous image frame.

9. The method of claim 1, wherein the obtaining of the actual backlight brightness value for each of the plurality of the backlight partitions with respect to the current frame image by processing the first backlight brightness value according to the scene type determined comprises:

determining a second backlight brightness value for each backlight partition with respect to the current frame image according to a maximum first backlight brightness value among the first backlight brightness values for the plurality of backlight partitions with respect to the current frame image, in response to determining that the current frame image is in a second scene mode, wherein the second backlight brightness value is greater than the first backlight brightness value for each backlight partition; and determining a second brightness difference between the second backlight brightness value for each backlight partition with respect to the current frame image and the actual backlight brightness value for each backlight partition with respect to the previous frame image; and determining the actual backlight brightness value for each backlight partition with respect to the current frame image according to the second brightness difference.

10. The method of claim 9, wherein the determining of the second backlight brightness value for each backlight partition with respect to the current frame image according to the maximum first backlight brightness value among the first backlight brightness values for the plurality of backlight partitions with respect to the current frame image comprises:

determining the maximum first backlight brightness value among the first backlight brightness values for the plurality of backlight partitions with respect to the current frame image; and determining the second backlight brightness value for each backlight partition with respect to the current frame image, according to the maximum first backlight brightness value, the second reference brightness value, and the first backlight brightness values for the plurality of backlight partitions with respect to the current frame image.

11. The method of claim 10, wherein the determining of the second backlight brightness value for each backlight partition with respect to the current frame image according to the maximum first backlight brightness value, the second reference brightness value, and the first backlight brightness values for the plurality of backlight partitions with respect to the current frame image comprises:

using the second reference brightness value as the second backlight brightness value for the backlight partition with respect to the current frame image, in response to the maximum first backlight brightness value being less than or equal to the second reference brightness value; and using a value as the second backlight brightness value for the backlight partition with respect to the current frame image, in response to the maximum first backlight brightness value being greater than the second reference brightness value, wherein the value is obtained by dividing the second backlight brightness value for the backlight partition with respect to the current frame image by the maximum first backlight brightness value so as to obtain a quotient, multiplying the quotient with a difference obtained by subtracting the second reference brightness value from the maximum first backlight brightness value to obtain a compressed brightness value, and adding the second reference brightness value to the compressed brightness value.

12. The method of claim 9, wherein the determining of the actual backlight brightness value for each backlight partition with respect to the current frame image according to the second brightness difference comprises:

using the second backlight brightness value for the backlight partition with respect to the current frame image as the actual backlight brightness value for the backlight partition with respect to the current frame image, if the absolute value of the second brightness difference is smaller than the preset brightness change step value;

using a sum obtained by adding the actual backlight brightness value for the backlight partition with respect to the previous frame image to the preset brightness change step value, as the actual backlight brightness value for the backlight partition with respect to the current frame image, if the absolute value of the second brightness difference is greater than the preset brightness change step value and the second backlight brightness value for the backlight partition with respect to the current frame image is greater than the actual backlight brightness value for the backlight partition with respect to the previous frame image; and using a difference obtained by subtracting the preset brightness change step value from the actual backlight brightness value for the backlight partition with respect to the previous frame image, as the actual backlight brightness value for the backlight partition with respect to the current frame image, if the absolute value of the second brightness difference is greater than the preset brightness change step value and the second backlight brightness value for the backlight partition with respect to the current frame image is smaller than the actual backlight brightness value for the backlight partition with respect to the previous frame image.

13. An electronic device comprising:

a processor; and a memory configured to store machine-readable instructions which when executed by the processor, cause the processor to execute the method for controlling the backlight of claim 1.

14. A display device comprising:

a backlight module comprising a plurality of backlight partitions;

a display unit configured to display an image frame; and the electronic device of claim 13.

15. A non-transitory computer-readable storage medium having stored thereon computer programs that are configured to, when executed by a processor, implement the method according to claim 1.

* * * * *